9. placing said first radially extending annular flange adjacent said second radially extending annular flange with said outer surface engaging the inner surface of said annular axially extending flange means with an interference or "snap" engagement fit and aligning the holes of said second radially extending annular flange with those in said first radially extending annular flange, 10. placing bolt means through each of the aligned openings of said first radially extending annular flange and said second radially extending annular flange, 11. forming the head and nut of each of said bolt means so that they extend over an axial line passing along the mating outer surface of said first radially extending annular flange and the inner surface of said annular axially extending flange means of said second radially extending annular flange adjacent the bolt means, 12. tightening said bolt means so that said two axially extending flanges of said flange means engages said first radially extending annular flange.

* * * * *

SAFETY DOOR LATCH MECHANISM

BACKGROUND OF THE INVENTION

The present invention relates to door assemblies for vehicle having one or more of such doors, preferably on the sides of the vehicle, and preferably hinged about a substantially vertical axis.

It has been widely recognized that a person involved in an automobile accident is in danger of being hurled out of the vehicle upon the door's opening due to the force of the accident impact. Upon a driver and/or passenger being hurled out of the vehicle, they may be injured, at times fatally, by contact with the pavement, or by being thrown into the path of an oncoming vehicle, or even by being crushed by the vehicle in which they were riding. This hazard is the direct cause of many injuries and deaths throughout the country.

Many proposals have been made by the prior art of methods and apparatus for preventing vehicle doors from opening in case of severe accidents. Note for instance, U.S. Pat. Nos. 3,468,392 and 3,431,998, both of which involve explosive driven bolts. Also note U.S. Pat. Nos. 3,479,767; 3,788,685 and 3,830,332.

U.S. Pat. No. 3,869,128 is directed to a safety latch mechanism for vehicle doors to prevent accidental opening of the doors, with the latching mechanism located at the vehicle hinge.

U.S. Pat. No. 3,819,228 is directed to a mechanism for locking a door to withstand side impacts, and involves the use of mating male and female members.

In the case of an accident, not only should a safety latch mechanism keep the vehicle doors from opening to such a degree that the driver or passengers therein could be hurled out of the vehicle, but the doors themselves must be readily opened by rescuers, so that seriously injured vehicle occupants can be readily removed therefrom. In spite of the serious effort that has been devoted by the prior art to solving the vehicle door opening hazard, no door locking device now on the market will reliably protect the driver and pasengers from being cast out of the vehicle, and also allow rescuers to readily open the vehicle door to remove the occupants of the vehicle therefrom.

SUMMARY OF THE INVENTION

The present invention is directed to a vehicle door assembly having a safety latch mechanism which prevents the possibility of the doors opening in case of an accident to a degree sufficient to permit the occupants from being cast out of the vehicle. At the same, the safety latch mechanism permits the doors to be readily opened after an accident has occured. This is accomplished by having the door latched to the door frame by means of mating male and female elements, with the male element mounted upon the door frame by means of a releasable or rupture means, such as a shear key. When the male member is released from mounted engagement with door frame, such as by rupture of a shear key, the male member remains attached to the door frame by means of a flexible cable, or the like, which allows the door to open but only to a predetermined degree. The door is permitted to open far enough to allow rescuer to reach inside the vehicle to operate the interior door handle, but the door does not open far enough to permit the vehicle occupants to be cast therefrom.

DESCRIPTION OF THE INVENTION

The vehicle door assembly, having the safety latch mechanism of the present invention, includes a door having inner and outer sides, a frame for the door, hinges for pivotally connecting the door to the frame, latch means which include mating male and female elements which are mounted on the frame and door respectively, and door handle means which are manually operable and connected to the female element to disengage the female element from the mating engagement with said male element to allow pivotable movement of said door relative to said frame. The male element is releasably retained on the frame by means of a shear pin or the like, which upon rupture or release will disengage the male member from mounted engagement upon the door frame. Such releasable disengagement of the male element occurs when the door assembly is under abnormal stress, such as in the case of an accident. Second retaining means are provided to retain the door to the door frame so that the door opens only a predetermined amount when the male element is released from mounted engagement on the frame. Preferably the second retaining means is a cable attached to the male element and to the door frame, with the cable being of such length as to permit the door to open approximately six inches or so.

The cable which connects the male members to the door frame is normally at least three inches longer than the length required for assembly (that is, the cable has at least about three inches of slack in it when the male element is in mounted engagement upon the door frame). Preferably, the cable is about four to ten inches longer than required for assembly, most preferably 6 inches longer than required for assembly.

The male element preferably includes a shaft which terminates at one end in an enlarged conical end of substantial larger diameter of the shaft, with the cable attached to the end of the shaft opposite the enlarged conical end. The female element is preferably a pair of notched plates which fit around the male element shaft and engage the enlarged conical end of the male element. The pair of notched plates are pivotably mounted to move into and out of retaing engagement with the male element. The pivotably mounted notched plates are biased toward each other by a spring or the like, so that they will engage with the male element inserted therein unless the door handle is operated.

DETAILED DESCRIPTION OF THE INVENTION

The invention will be more clearly understood with reference to the accompanying drawings, wherein.

Figure 3:
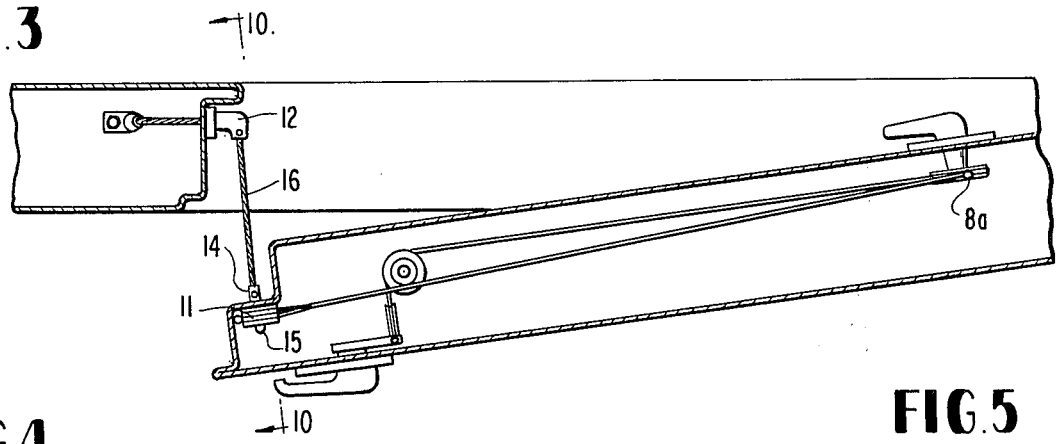
FIG. 3 is a view the same as FIGS. 1 and 2, but showing the door in a partially opened condition, caused by abnormal stresses such as a vehicular accident.
Figure 4:
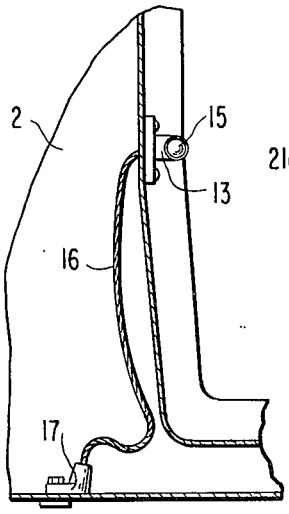
FIG. 4 is a cross-sectional view taken along line 4—4 of FIG. 2, and illustrating the male element and its attachment to the vehicular frame.
Figure 5:
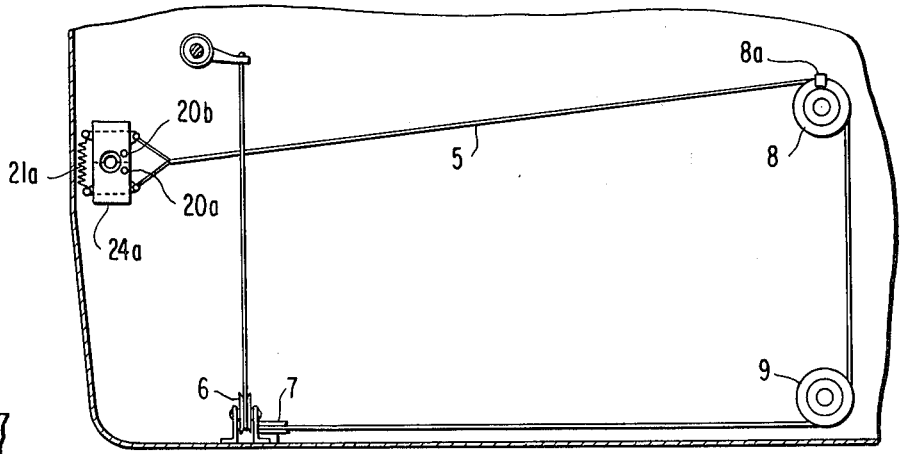
FIG. 5 is a cross-sectional view, taken along line 5—5 of FIG. 2, illustrating the female member and the door handle latch release mechanism.
Figure 6:
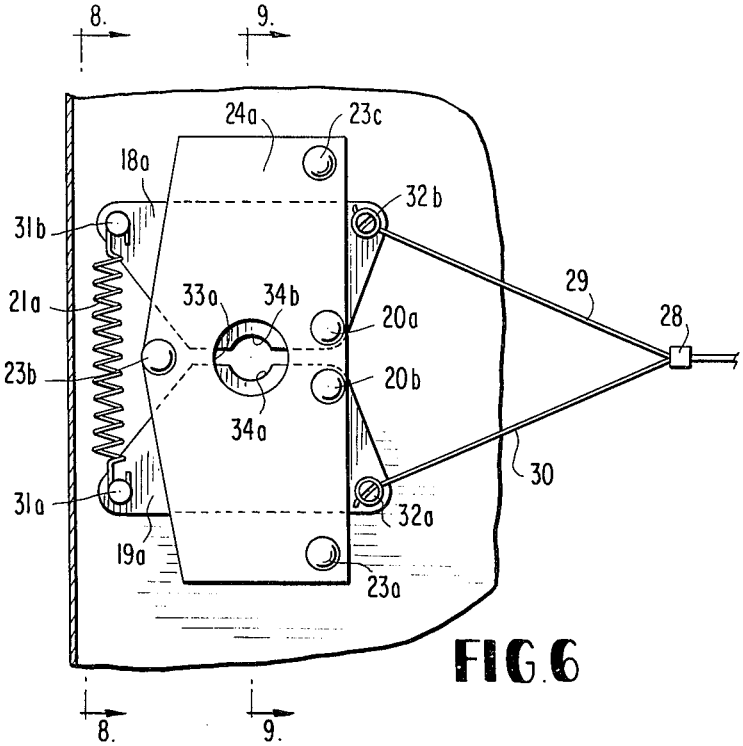
FIG. 6 is an enlarged side view of the female element of FIG. 5, shown in a closed position.
Figure 8:
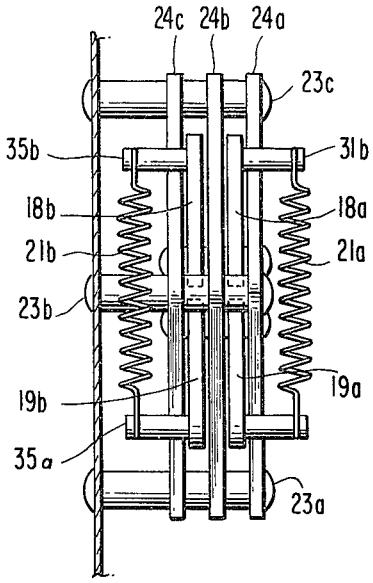
FIG. 8 is a cross-sectional view of the female element, taken along line 8—8 of FIG. 6.
Figure 9:
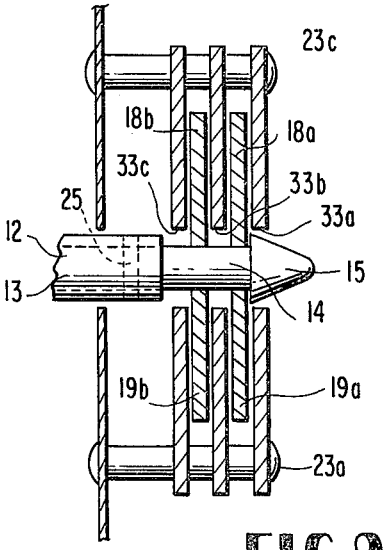
Figure 10:
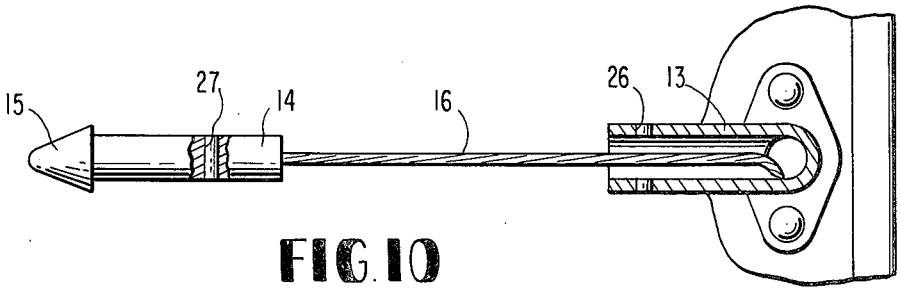

FIG. 9 is a further cross-sectional view of the female element, taken along line 9—9 of FIG. 6, with the male element shown engaged therewith; and FIG. 10 is a partial sectional view of the male element, shown in a position to retain the vehicle door if engaged with the female element (not shown). This view generally corresponds, except for the absence of the female element and the vehicle door, with the view taken along line 10—10 of FIG. 3.

The drawings illustrate door 1 and mating door frame 2. Door 1 has inner handle 3 and outer handle 4, operating through cable 5 over pulleys 6, 7, 8, and 9 to operating locking device 10. Inner door handle 3 is attached by pin 8*a* to cable 5.

Locking device 10 includes female element 11 and male element 12. The male element 12 includes a collar fitting 13, a shaft 14 having an enlarged conical end 15. The shaft 14 is retained in collar fitting 13 by shear pin 25. The end of shaft 14 removed from conical end 15 is attached to one end of cable 16, the other end of which is attached to clip 17 bolted to door frame 2, (or bolted to other part of the vehicle assembly.)

The female element includes notched plates 18 *a* and b notched plates 19 *a* and *b*, which are pivotally mounted by hinge pins 20*a* and 20*b* on plates 24*a*, 24*b* and 24*c*. Plates 24*a*, 24*b* and 24*c* are mounted on the car door by rivets 23*a*, 23*b* and 23*c*.

Hole 26 in collar fitting 13 and hole 27 in shaft 14 receive the shear pin 25, and are releasably held together by shear pin 25.

Cable 5 from the door handle is connected to cables 29, 30 by fitting 28. Cable 29 is connected by pin 32*b* to plates 18 *a* and *b*, and cable 30 is connected by pin 32*a* to notched plates 19*a* and 19*b*. Spring 21*a* is in hooked engagement with pin 31*a* and 31*b*, and thus attached to notched plates 18*a* and 19*a*. Spring 21*b* is in hook engagement with pins 35*a* and 35*b* and thus connected to notched plates 18*b* and 19*b*. Holes 33*a*, 33*b* and 33*c* in plates 24*a*, 24*b* and 24*c*, respectively, permit the male member to enter the female member.

Notches 34*a* and 34*b* in notched plates 18*a* and 19*a*, and 18*b* and 19*b*, fit around shaft 14 but engage the rear portion of enlarged conical end 15 in order to firmly hold the male member within the female member. This is best known with reference to FIG. 9, wherein plates 18*a* and 19*a* engage the back of the conical end 15.

Two pairs of notched plates 18*a* and 19*a*, and 18*b* and 19*b*, are utilized to provide for possible misalignment of door 1 in frame 2. Only one pair of notched plates is required, but with two plates the door may be subjected to considerable warpage or other misalignment, and still be latchable by mating engagement of the female element around the male element.

OPERATION

From the above description, it will be readily appreciated that the device includes a spring loaded female element which maintains a closed position until opened by the door opening handles, or until penetrated by male portion of the device. After penetration by the enlarged conical end 15 of the device, the notched plate 18*a* or 18*b* and 19*a* or 19*b* fit around shaft 14 to retain the male element within the female element. At this time, the only way the door will open in normal operation is to use the manually operable latch release door handle.

The male element is attached by a cable of aircraft rated design to the vehicle frame. This cable is preferably about six inches longer than is needed for assembly, or, expressed otherwise, has about six inches of slack in it when the male element is mounted on the door frame by means of a shear pin. Upon rupture of the shear pin, the cable allows the door to open to a position of generally no more than six inches wide, which limited opening retains the vehicle occupants within the vehicle in the event of a crash, but allows rescue personnel to enter the vehicle by reaching inside and unlocking the door and operating door handles.

On some occasions a vehicle will be so vastly distorted by an accident that nothing will keep it from opening, and the present device compensates for such distortion by limiting the opening of the door to an extent such that a person cannot be cast out of the vehicle.

If a driver of an automobile has a heart attack or other medical problem while driving, and is able to bring his car to rest without having an accident, medical personnel can obtain entry to a locked car without having to destroy the entire door by simply exerting the proper amount of torque, at which time the shear pin will rupture and the door will open a degree sufficient to permit the door handles to be operated.

Upon the shear pin rupturing and the door being opened as described above, the door latch may be repaired readily by simply inserting another shear pin into the mating holes in shaft 14 and collar fitting 13.

Through its simplicity of design the safety latch mechanism of the present invention can be manufactured, assemblied and installed for a fraction of the cost of prior art safety latch mechanisms. Assembly of the present safety latch mechanism is simplified, as there are no bars to bend, no pins to fall out, and other factors of door opening failures of presently available systems have been eliminated.

Another advantage of the present invention is in the event an accident is so severe that the door handles are rendered inoperative, the mere use of a bolt cutter on the restraining cable 16 permits access to occupants of the vehicle.

Figure 1:
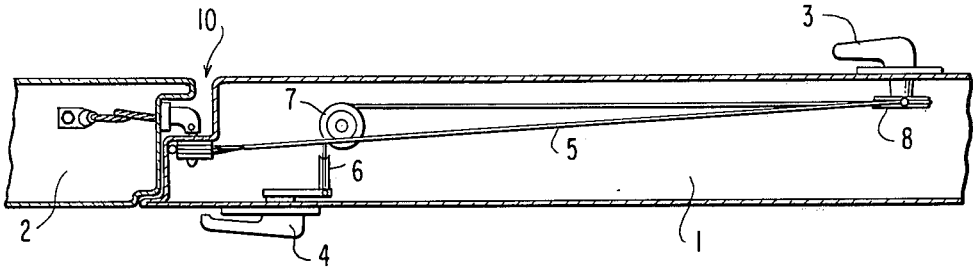
FIG. 1 is an overhead cross-sectional view of the vehicle door assembly of the present invention, shown in a normal closed position.
Figure 2:
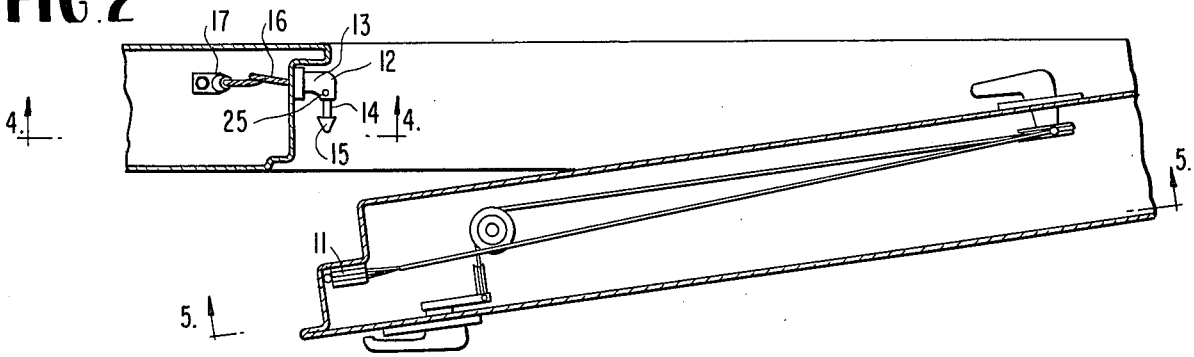
FIG. 2 is a view the same as FIG. 1, but showing the door in normal open position, wherein the door was opened by operation of the door handle.

In the position shown in FIG. 1 of the accompanying drawings, the door has been closed and the male element 12 has been engaged by female element 11, holding the door secure until handle 3 or 4 are operated. After the handle 3 or 4 have been operated, the door opens as shown in FIG. 2. When the door is in the position shown in FIG. 1, and the vehicle is subjected to a severe accident, shear pin 25 will rupture and the door will open to the limited extent illustrated in FIG. 3. It will be readily appreciated from FIG. 3 that cable 16 is readily accessible for use of a bolt cutter or the like and also that sufficient room has been provided for a person to reach between the door and the door frame in order to operate inner door handle 3, to thereby release the male member from the female member.

Figure 7:
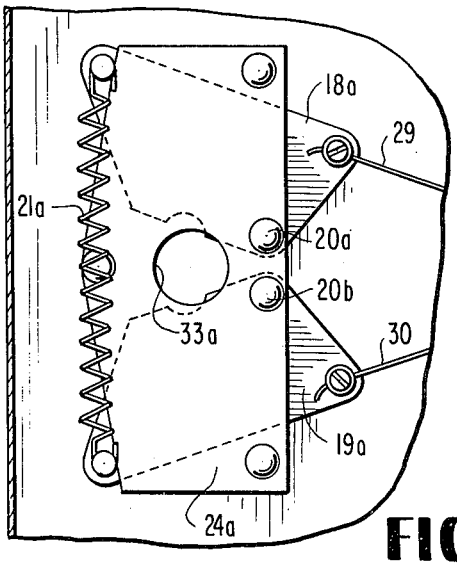
FIG. 7 is the same as FIG. 6, but with the female element illustrated in the open position, caused by operation of the door handle release mechanism.

The operation of door handle 3 or door handle 4 moves the notched plates from the position shown in FIG. 6 to the position shown in FIG. 7, so that the male member, which had been retained in the female member, may be readily withdrawn therefrom.

I claim:

1. In a vehicle door assembly having a safety latch mechanism, said assembly comprising a door having inner and outer sides, a frame for said door, hinged means pivotally connecting said door to said frame, latch means comprising an elongated male element on said frame and having an end portion mating with female elements on said door, manually operable latch release door handle means connected to said female elements to disengage same from said male element on said frame to allow pivotally movement of said door relative to said frame, the improvement comprising:

sleeve mounting means attached to said frame for normally receiving an end portion of said male element distal to said latch means; connecting means extending through said sleeve means and between an end of said male element normally received in said sleeve means and said frame for permitting displacement of said male element out of said sleeve means only a predetermined distance; releaseable retaining means carried by said sleeve means and male element for retaining the end portion of said male element therein and for releasing the end of said male element responsive to a predetermined torque applied to said latch means so that under abnormal stress said door will open relative to said frame only a predetermined amount when said male element is released from said sleeve mounting means.

2. The device of claim 1 wherein said connecting means is a cable, one end of which is attached to said male element, and the other end of which is attached to said frame, said cable being at least three inches longer than required for assembly.

3. The device of claim 2 wherein said sleeve means and the end of said male element normally received therein have aligned apertures and said releaseable retaining means is a shear pin extending through said apertures.

4. The device of claim 3 wherein said male element includes a shaft terminating in a conical end of substantially larger diameter than said shaft, said conical end normally mating with said female elements in said latch means.

5. The device of claim 4 wherein said female elements comprise a pair of plate means which engage the enlarged conical end of said male element.

6. The device of claim 5 wherein said pair of plate means are pivotally mounted to move into and out of retaining engagement with said male element.

7. The device of claim 6 wherein said pair of plate means are biased toward each other to the position wherein they are engaged with, or engageable with said male element.

8. The device of claim 7 wherein said cable is about 4 to 10 inches longer than required for assembly.

9. The device of claim 8 wherein said cable is about 6 inches longer than required for assembly.

* * * * *